US006075000A

United States Patent [19]

Rohrbaugh et al.

[11] Patent Number: 6,075,000

[45] Date of Patent: Jun. 13, 2000

[54] BLEACH COMPATIBLE ALKOXYLATED POLYALKYLENEIMINES

[75] Inventors: Robert Henry Rohrbaugh; James Albert Cleary, both of Indian Springs; Shulin Zhang, West Chester; Eugene Paul Gosselink, Cincinnati, all of Ohio

[73] Assignee: The Procter & Gamble Company, Cincinnati, Ohio

[21] Appl. No.: 09/103,135

[22] Filed: Jun. 23, 1998

Related U.S. Application Data

[60] Provisional application No. 60/051,517, Jul. 2, 1997.

[51] Int. Cl.[7] ..... C11D 3/00; C11D 3/30; C11D 3/395; D06L 3/00

[52] U.S. Cl. ..... 510/299; 510/302; 510/499; 510/528

[58] Field of Search ..... 510/350, 367, 510/299, 302, 528, 499

[56] References Cited

U.S. PATENT DOCUMENTS

| | | | |
|---|---|---|---|
| 2,182,306 | 12/1939 | Ulrich et al. | 260/2 |
| 2,208,095 | 7/1940 | Esselmann et al. | 260/2 |
| 2,553,696 | 5/1951 | Wilson et al. | 260/239 |
| 2,806,839 | 9/1957 | Crowther et al. | 260/77.5 |
| 3,033,746 | 5/1962 | Moyle et al. | 167/31 |
| 4,597,898 | 7/1986 | Vander Meer et al. | 252/529 |
| 4,676,921 | 6/1987 | Vander Meer et al. | 252/174 |
| 4,891,160 | 1/1990 | Vander Meer et al. | 252/545 |
| 5,565,145 | 10/1996 | Watson et al. | 510/350 |
| 5,747,440 | 5/1998 | Kellett et al. | 510/276 |

FOREIGN PATENT DOCUMENTS

| | | | |
|---|---|---|---|
| 1597097 | 9/1981 | United Kingdom . | |
| WO 97/42286 | 11/1997 | WIPO | C11D 3/37 |
| WO 97/42288 | 11/1997 | WIPO | C11D 3/37 |
| WO 98/12295 | 3/1998 | WIPO | C11D 3/37 |
| WO 98/12296 | 3/1998 | WIPO | C11D 3/37 |
| WO 98/20098 | 5/1998 | WIPO | C11D 3/37 |
| WO 98/20099 | 5/1998 | WIPO | C11D 3/37 |

*Primary Examiner*—Yogendra Gupta
*Assistant Examiner*—John M Petruncio
*Attorney, Agent, or Firm*—Richard S. Echler; Kim W. Zerby; Jacobus C. Rasser

[57] ABSTRACT

The present invention relates to laundry detergent compositions which comprise bleach compatible hydrophobic soil dispersants. The dispersants are polyalkyleneimines having a backbone molecular weight of from about 2000 to about 5000 daltons and having most of the N—H unit hydrogens, preferably all N—H unit hydrogens substituted with from about 20 to about 50, alkyleneoxy units.

28 Claims, No Drawings

BLEACH COMPATIBLE ALKOXYLATED POLYALKYLENEIMINES

This Appln claims benefit of provisional appln 60/051,517 Jul. 2, 1997.

FIELD OF THE INVENTION

The present invention relates to alkoxylated polyalkyleneimines which are compatible with bleach. The alkoxylated polyalkyleneimines are also useful as hydrophobic soil dispersants which are suitable for use in laundry detergent compositions which comprise a bleaching agent. The alkoxylated polyalkyleneimines are also suitable for use as soil dispersant in bleach-containing laundry pre-soaks and bleaching agents.

BACKGROUND OF THE INVENTION

Absent a suitable dispersant, hydrophobic (e.g., grime, oil, soot) and hydrophilic (e.g. clay) soil which is removed during the washing step of the laundry process can re-deposit onto the cleaned fabric. Soil dispersants act by sequestering dirt once it is dissolved or dispersed in the laundry liquor and keeps the suspended soil in the laundry liquor where it can be carried away during the normal rinsing process.

Typically, if bleaching agents are present, especially peroxygen bleaches which are formulated into both liquid and granular laundry detergent compositions, the formulator must consider the instability of a particular soil dispersant toward bleach. Many successful dispersants have polyalkyleneamine or polyalkyleneimine backbones which are susceptible to oxidation at the amine functionalities and potentially to breakdown or fragmentation by bleaching agents which may be present. From another view, the interaction of bleaching agents with these polyalkyleneimine-based dispersants depletes the amount of bleach present therefore affecting the bleaching performance.

Accordingly, there remains a need in the art for bleach compatible, highly effective hydrophobic soil dispersants. Surprisingly, it has been found that certain higher molecular weight polyalkyleneimines when highly alkoxylated, are compatible with bleach in laundry compositions and additionally provide hydrophobic soil dispersion. It has also been found that it can be beneficial that the alkoxylated dispersants comprise in the alkylene oxide substituant group mixtures of ethylene oxide and propylene oxide.

BACKGROUND ART

The following disclose various soil dispersants or modified polyamines; U.S. Pat. No. 5,565,145, Watson et al., issued Oct. 15, 1996; U.S. Pat. No. 4,891,160, Vander Meer, issued Jan. 2, 1990; U.S. Pat. No. 4,726,909, Otten et al., issued Feb. 23, 1988; U.S. Pat. No. 4,676,921, Vander Meer, issued Jun. 30, 1987; U.S. Pat. No. 4,548,744, Connor, issued Oct. 22, 1985; U.S. Pat. No. 4,597,898, Vander Meer, issued Jul. 1, 1986; European Patent Application 0 206 515, published Dec. 30, 1986.

SUMMARY OF THE INVENTION

The present invention meets the aforementioned needs in that it has been surprisingly discovered that ethoxylated polyalkyleneimines having a backbone molecular weight of greater than about 2,000. daltons and an average degree of alkyleneoxylation per N—H unit of from about 20 to about 50 alkyleneoxy units provides a hydrophobic soil dispersant which is compatible with bleach. The alkoxylated polyalkyleneimines of the present invention are suitable for use in high and low density granular, heavy duty and light duty liquids, as well as laundry bar detergent compositions.

A first aspect of the present invention relates to a hydrophobic soil dispersant having the formula:

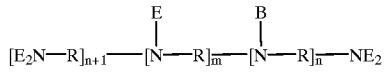

wherein R is $C_2$–$C_6$ linear alkylene, $C_3$–$C_6$ branched alkylene, and mixtures thereof, E is an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof; $R^2$ is hydrogen, $C_1$–$C_4$ alkyl, and mixtures thereof; m is from about 10 to about 70; n is from about 5 to about 35; and x is from about 20 to about 50; and B represents a continuation of the structure by branching.

The present invention further relates to laundry detergent compositions comprising:

a) at least about 0.01% to about 95%, preferably from about 0.1% to about 60%, more preferably from about 0.1% to about 30% by weight, of a detersive surfactant selected from the group consisting of anionic, nonionic, cationic, zwitterionic, and ampholytic surfactants, and mixtures thereof;

b) from about 0.05% to about 30%, more preferably from about 1% to about 30%, most preferably from about 5% to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof;

c) from about 0.01 to about 10% by weight, of a water-soluble or dispersible, alkoxylated polyamine according to the present invention; and d) the balance carriers and adjunct ingredients wherein the adjunct ingredients are selected from the group consisting of builders, optical brighteners, bleaches, bleach boosters, bleach catalysts, bleach activators, soil release polymers, dye transfer agents, dispersents, enzymes, suds suppressers, dyes, perfumes, colorants, filler salts, hydrotropes, enzymes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof A yet further aspect of the present invention relates to a laundry bleaching composition comprising:

a) from about 0.05% to about 30%, more preferably from about 1% to about 30%, most preferably from about 5% to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof;

b) from about 0.05% to about 50%, preferably from about 1% to about 60%, more preferably from about 5% to about 30% by weight, of a bleach activator;

c) from about 0.01% to about 10% by weight, a water-soluble or dispersible, alkoxylated polyamine according to the present invention; and d) the balance carriers and adjunct ingredients.

These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The bleach compatible alkoxylated polyalkyleneimines of the present invention comprise backbones that are typically branched, however, linear backbones are also suitable. In general, the polyamine backbones described herein are modified in such a manner such that each nitrogen of the polyamine chain which has an attached hydrogen atom has that hydrogen atom replaced with alkyleneoxy unit, for example, an ethyleneoxy unit or propyleneoxy units or mixtures thereof. Polyamines which have undergone the replacement of essentially all hydrogen atoms with an alkyleneoxy unit are herein defined as "modified".

The polyamine backbones of the present invention have the general formula:

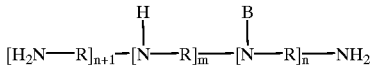

said backbones prior to subsequent modification, comprise primary, secondary and tertiary amine nitrogens connected by R "linking" units. The backbones are comprised of essentially three types of units, which may be randomly distributed along the chain. Primary amine units having the formula:

$H_2N—R]—$ and $—NH_2$ which terminate the main backbone and any branching chains, secondary amine units having the formula:

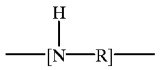

and which, after modification, have their hydrogen atom substituted by an alkyleneoxy unit, and tertiary amine units having the formula:

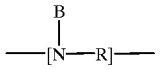

which are the branching points of the main and secondary backbone chains, B representing a continuation of the chain structure by branching. The tertiary units have no replaceable hydrogen atom and are therefore not modified by substitution with an alkyleneoxy unit. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines. Cyclic polyalkyleneimines are less preferred.

R is $C_2$–$C_6$ linear alkylene, $C_3$–$C_6$ branched alkylene, and mixtures thereof, preferably ethylene or propylene, which can be1,2-propylene or 1,3-propylene or mixtures thereof, or mixtures of propylene and ethylene. The preferred polyalkyleneimines of the present invention have backbones which comprise the same R unit, for example, all units are ethylene. Most preferred backbone comprises R groups which are all ethylene units.

The polyalkyleneimines of the present invention are modified by substitution of most, preferably each N—H unit hydrogen with an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof, preferably ethylene and/ or propylene, which may be 1,2-propylene or 1,3-propylene or mixtures thereof, and it may be preferred that mixtures of ethylene and propylene are present. $R^2$ is hydrogen, $C_1$–$C_4$ alkyl, and mixtures thereof, preferably hydrogen or methyl, more preferably hydrogen. It may be preferred for the purpose of the present invention, that the alkyleneoxy unit comprises a mixture of $R^1$ groups, being ethylene or propylene, whereby the ratio of propylene to ethylene $R^1$ groups is preferably from 1:100 to 1:4, more preferably from 1:50 to 1:5, more preferably from 1:15 to 1:7. Thus, it may be preferred that the 80% to 95% of the $R^1$ groups is ethylene and 5% to 20% of the $R^1$ groups is propylene. It has been found that in particular, dispersants of this type, which have one or more propylene $R^1$ groups directly substituted to the N—H-unit, followed by ethylene $R^1$ groups are very bleach compatible. The value of the index x is from about 20, preferably from about 25; to about 50, preferably about 40, most preferably x is 30.

The relative number of primary secondary and tertiary amine units in the backbone prior to modification is reflected in the values of the indices m and n. In general, the polyamines of the present invention will have a ratio of primary amine: secondary amine:tertiary amine of from about 1:2:1 to about 1:1:1, that is the starting polyamines having the general formula:

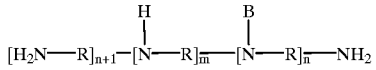

wherein R is an alkylene unit defined herein below, generally have the values of n+1, m, and n in the ratio of from about 1:2:1 to about 1:1:1. The preferred molecular weight for the polyamine backbones is from about 2000, preferably from about 2500, more preferably from about 3000 to about 5000, preferably to about 4500, more preferably to about 4000 daltons, most preferably 3000 daltons. The indices m and n will vary depending upon the R moiety which comprises the backbone. For example, when R is ethylene a backbone unit averages about 43 gm and when R is hexylene a backbone unit averages about 99 gm. By way of illustration and not limitation, a polyalkyleneimine backbone having an average molecular weight of about 3000 wherein R is ethylene and the ratio of m to n of about 2:1 has the value of m equal to about 35 and the value of n equal to about 17. In this example secondary amine units comprise about 35 backbone units, tertiary amine units comprise about 17 units and primary amine units comprise about 18 units. Typically, for polyamines having a 1:2:1 ratio, the value for m ranges from about 10, preferably from about 24, more preferably from about 30; to about 70, preferably to about 60, more preferably to about 40; the value for n ranges from about 5, preferably from about 10, more preferably from about 15; to about 35, preferably to about 25, more preferably to about 20.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

The following is an example of a preferred embodiment of the present invention, polyethyleneimine (R equal to ethylene) having an average backbone molecular weight of about 3000 having the formula:

PEI 3000 $E_{30}$

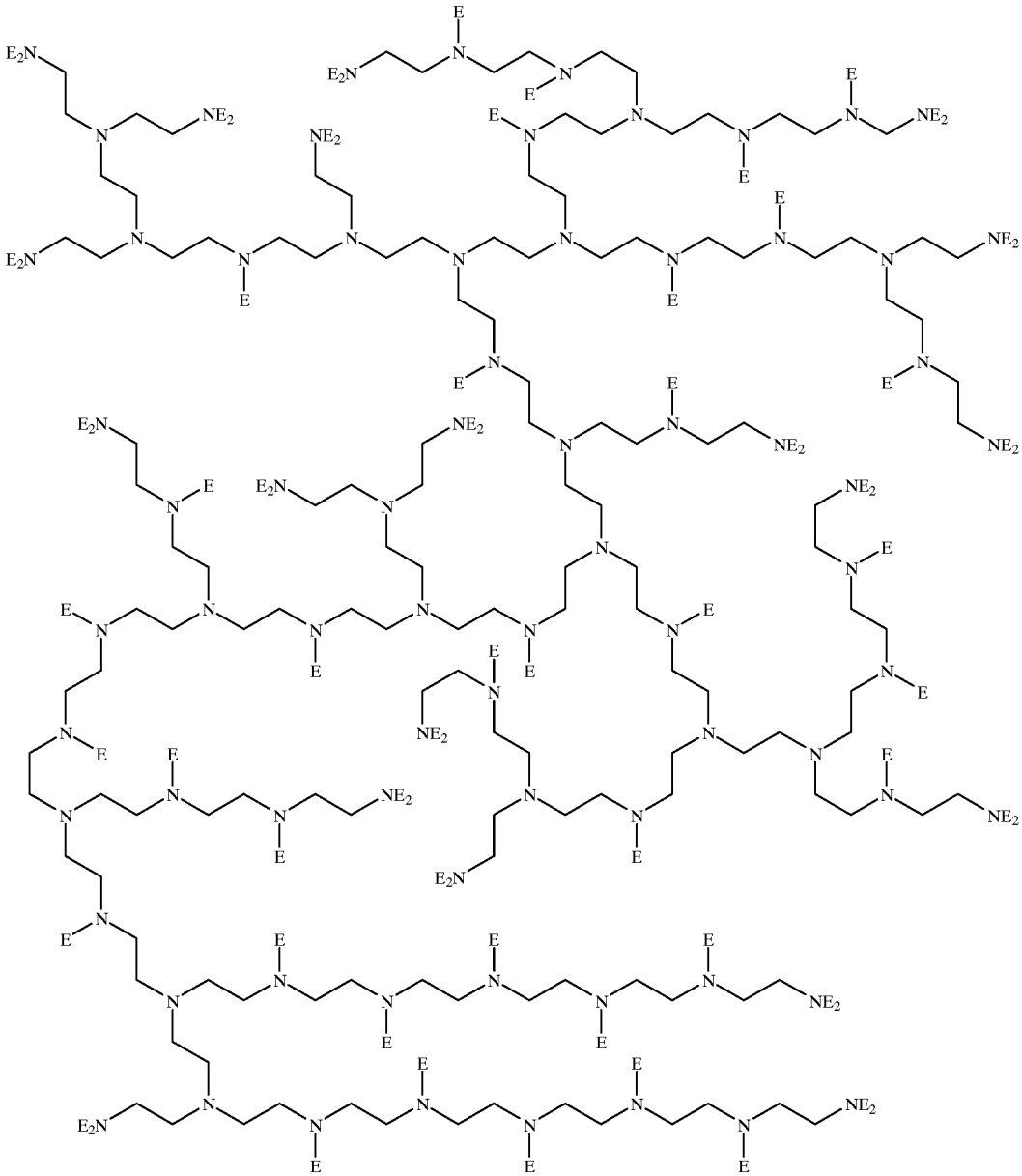

wherein E is $—(R^1O)_xR^2$ wherein $R^1$ is ethylene, $R^2$ is hydrogen and x is equal to about 30 (Example 1 herein below). Another example of a preferred embodiment of the invention is a dispersant of the following formula:

PEI 3000 $P_3E_{27}$

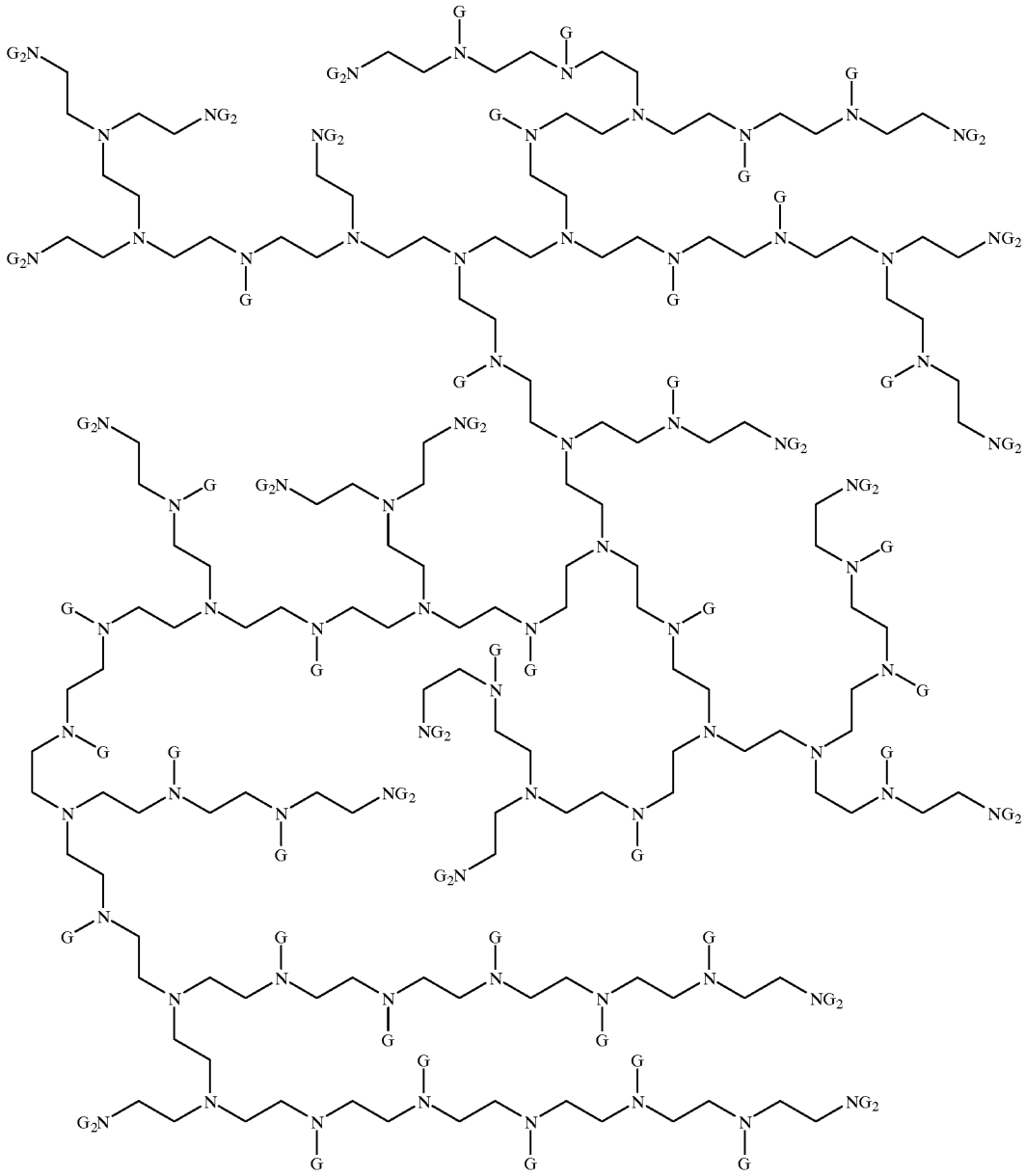

wherein G is a unit having the formula $—(R^1O)_y(R^{II}O)_xR^2$ wherein $R^1$ is 1,2-propylene, $R^{II}$ is ethylene, $R^2$ is hydrogen and x is about 3 and y is about 27 (Example 2 herein below).

Alkoxylated Polyalkyleneimine Compositions

The present invention further relates to laundry detergent compositions comprising:

a) from about 0.01%, preferably from about 0.1%, more preferably from about 0.1% to about 95%, preferably to about 60%, more preferably to about 30% by weight, of a detersive surfactant selected from the group consisting of anionic, nonionic, cationic, zwitterionic, and ampholytic surfactants, and mixtures thereof;

b) from about 0.05%, preferably from about 1%, more preferably from about 5% to about 30%, preferably to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof;

c) from about 0.01% to about 10% by weight, of a water-soluble or dispersible, alkoxylated polyamine according to the present invention; and d) the balance carriers and adjunct ingredients wherein the adjunct ingredients are selected from the group consisting of builders, optical brighteners, bleach catalysts, bleach activators, soil release polymers, dye transfer agents, dispersents, enzymes, suds suppressers, dyes, perfumes, colorants, filler salts, hydrotropes, enzymes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

Preferred laundry detergent compositions according to the present invention comprise:

a) from about 0.01%, preferably from about 0.1%, more preferably from about 0.1% to about 95%, preferably to about 60%, more preferably to about 30% by weight, of a detersive surfactant selected from the group consisting of anionic, nonionic, cationic, zwitterionic, and ampholytic surfactants, and mixtures thereof;

b) from about 0.01%, preferably from about 0.1%, more preferably from about 0.5% to about 10%, preferably to about 5%, more preferably to about 2% by weight, of a soil release polymer;

c) from about 0.05%, preferably from about 1%, more preferably from about 5% to about 30%, preferably to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof, d) from about 0.01% to about 10% by weight, of a water-soluble or dispersible, alkoxylated polyamine according to the present invention;

e) from 0.05%, preferably from about 1% to about 50% by weight, preferably to about 20% more preferably to about 10%, most preferably to about 5% by weight of one or more bleach activators, selected from hydrophobic and hydrophilic bleach activators, preferably a mixture of hydrophobic and hydrophilic bleach activators, preferably TAED and alkanoyl oxybenzene sulphonate such as nonanoyl oxy benzene sulphonate; and f) the balance carriers and adjunct ingredients wherein the adjunct ingredients are selected from the group consisting of builders, optical brighteners, bleach activators, soil release polymers, dye transfer agents, dispersents, enzymes, suds suppressers, dyes, perfumes, colorants, filler salts, hydrotropes, enzymes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

It may be preferred that the laundry detergent compositions according to the present invention comprise:

a) from about 0.01%, preferably from about 0.1%, more preferably from about 0.1% to about 95%, preferably to about 60%, more preferably to about 30% by weight, of a detersive surfactant selected from the group consisting of anionic, nonionic, cationic, zwitterionic, and ampholytic surfactants, and mixtures thereof;

b) from about 0.01% to about 10%, more preferably 0.1% to about 5%, more preferably from about 0.5% to about 2% by weight, of a soil release polymer;

c) from about 0.05% to about 30%, more preferably from about 1% to about 30%, most preferably from about 5% to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof;

d) from about 0.05% to about 50%, preferably 0.1% to about 5% by weight, of bleach activators, preferably bleach activators having the formula:

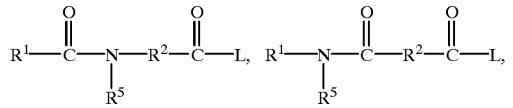

and mixtures thereof, wherein $R^1$ is $C_1$–$C_{14}$ alkyl, aryl, alkylaryl, and mixtures thereof; $R^2$ is $C_1$–$C_{14}$ alkylene, arylene, alkylarylene, and mixtures thereof; $R^5$ is hydrogen, $C_1$–$C_{10}$ alkyl, aryl, alkylaryl, and mixtures thereof; L is any suitable leaving group;

e) from about 0.01% to about 10% by weight, of a water-soluble or dispersible, alkoxylated polyamine according to the present invention; and f) the balance carriers and adjunct ingredients wherein the adjunct ingredients are selected from the group consisting of builders, optical brighteners, soil release polymers, dye transfer agents, dispersents, enzymes, suds suppressers, dyes, perfumes, colorants, filler salts, hydrotropes, enzymes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

The present invention also relates to laundry bleaching compositions comprising:

a) from about 0.05% to about 30%, more preferably from about 1% to about 30%, most preferably from about 5% to about 20%, by weight, of an oxygen bleaching agent said oxygen bleaching agent selected from the group consisting of alkali metal percarbonate, perborate, monoperphthalate, pyrophosphate peroxyhydrate, urea peroxy-hydrate and mixtures thereof;

b) from about 0.05% to about 50%, preferably 0. 1% to about 5% by weight, of a bleach activator, preferably a bleach activator having the formula:

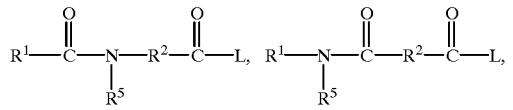

and mixtures thereof, wherein $R^1$ is $C_1$–$C_{14}$ alkyl, aryl, alkylaryl, and mixtures thereof; $R^2$ is $C_1$–$C_{14}$ alkylene, arylene, alkylarylene, and mixtures thereof; $R^5$ is hydrogen, $C_1$–$C_{10}$ alkyl, aryl, alkylaryl, and mixtures thereof; L is any suitable leaving group;

c) from about 0.01% to about 10% by weight, of a water-soluble or dispersible, alkoxylated polyamine according to the present invention; and d) the balance carriers and adjunct ingredients.

Detersive surfactants

The detersive surfactants suitable for use in the present invention are cationic, anionic, nonionic, ampholytic, zwitterionic, and mixtures thereof, further described herein below. The laundry detergent composition may be in any suitable form, for example, high density liquids, light liquids or other pourable forms in addition to granules or laundry bars. The cotton soil release polymers of the present invention can be formulated into any detersive matrix chosen by the formulator.

The laundry detergent compositions according to the present invention may additionally comprise from about 0.01%, preferably from about 0.1%, more preferably from about 1% to about 95%, preferably to about 60%, more preferably to about 30% by weight, of the following detersive surfactants. Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)X(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1-7 ethoxy sulfates), $C_{10}$–$C_{18}$ alkyl alkoxy carboxylates (especially the EO 1-5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The preferred compositions of the present invention comprise at least about 0.01%, preferably at least 0.1%, more preferably from about 1% to about 95%, most preferably from about 1% to about 80% by weight, of an anionic detersive surfactant. Alkyl sulfate surfactants, either primary or secondary, are a type of anionic surfactant of importance for use herein. Alkyl sulfates have the general formula $ROSO_3M$ wherein R preferably is a $C_{10}$–$C_{24}$ hydrocarbyl, preferably an alkyl straight or branched chain or hydroxyalkyl having a $C_{10}$–$C_{20}$ alkyl component, more preferably a $C_{12}$–$C_{18}$ alkyl or hydroxyalkyl, and M is hydrogen or a water soluble cation, e.g., an alkali metal cation (e.g., sodium potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12}$–$C_{16}$ are preferred for lower wash temperatures (e.g., below about 50° C.) and $C_{16}$–$C_{18}$ alkyl chains are preferred for higher wash temperatures (e.g., about 50° C.).

Alkyl alkoxylated sulfate surfactants are another category of preferred anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is hydrogen or a water soluble cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are $C_{12}C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

The laundry detergent compositions according to the present invention may additionally comprise at least about 0.01%, preferably at least about 0.1%, more preferably at least about 1% by weight, of conventional $C_{11}$–$C_{18}$ alkyl benzene sulfonates ("LAS"), preferably in laundry bar embodiments and in granular laundry detergent compositions.

The preferred compositions of the present invention also comprise at least about 0.01%, preferably at least 0.1%, more preferably from about 1% to about 95%, most preferably from about 1% to about 80% by weight, of an nonionic detersive surfactant. Preferred nonionic surfactants such as $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), block alkylene oxide condensate of $C_6$ to $C_{12}$ alkyl phenols, alkylene oxide condensates of $C_8$–$C_{22}$ alkanols and ethylene oxide/propylene oxide block polymers (Pluronic™-BASF Corp.), as well as semi polar nonionics (e.g., amine oxides and phosphine oxides) can be used in the present compositions. An extensive disclosure of these types of surfactants is found in U.S. Pat. No. 3,929,678, Laughlin et al., issued Dec. 30, 1975, incorporated herein by reference.

Alkylpolysaccharides such as disclosed in U.S. Pat. No. 4,565,647 Llenado (incorporated herein by reference) are also preferred nonionic surfactants in the compositions of the invention.

More preferred nonionic surfactants are the polyhydroxy fatty acid amides having the formula:

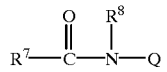

wherein $R^7$ is $C_5$–$C_{31}$ alkyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; $R^8$ is selected from the group consisting of hydrogen, $C_1$–$C_4$ alkyl, $C_1$–$C_4$ hydroxyalkyl, preferably methyl or ethyl, more preferably methyl. Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof. Preferred Q is derived from a reducing sugar in a reductive amination reaction. More preferably Q is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Q. It should be understood that it is by no means intended to exclude other suitable raw materials. Q is more preferably selected from the group consisting of —$CH_2(CHOH)_nCH_2OH$, —$CH(CH_2OH)(CHOH)_{n-1}CH_2OH$, —$CH_2(CHOH)_2$—$(CHOR')(CHOH)CH_2OH$, and alkoxylated derivatives thereof, wherein n is an integer from 3 to 5, inclusive, and $R^1$ is hydrogen or a cyclic or aliphatic monosaccharide. Most preferred substituents for the Q moiety are glycityls wherein n is 4, particularly —$CH_2(CHOH)_4CH_2OH$.

$R^7CO$—N< can be, for example, cocamide, stearamide, oleamide, lauramide, myristamide, capricamide, palmitamide, tallowamide, etc.

$R^8$ can be, for example, methyl, ethyl, propyl, isopropyl, butyl, 2-hydroxy ethyl, or 2-hydroxy propyl.

Q can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

A particularly desirable surfactant of this type for use in the compositions herein is alkyl-N-methyl glucomide, a compound of the above formula wherein $R^7$ is alkyl (preferably $C_{11}$–$C_{13}$), $R^8$, is methyl and Q is 1-deoxyglucityl.

Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used.

Bleaching Compounds - Bleaching Agents and Bleach Activators

The detergent compositions herein may optionally contain bleaching agents or bleaching compositions containing a bleaching agent and one or more bleach activators. When present, bleaching agents will be at levels of from about 0.05% to about 30%, more preferably from about 1% to about 30%, most preferably from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The peroxygen bleaching compounds useful herein are those capable of yielding hydrogen peroxide in an aqueous liquor. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired. Preferred peroxygen bleaching compounds include sodium perborate, commercially available in the form of mono-, tri-, and tetrahydrate, sodium pyrophosphate peroxyhydrate, urea peroxy-hydrate, sodium peroxide, peroxyphthalate and sodium percarbonate. Particularly preferred are sodium perborate tetrahydrate, sodium perborate monohydrate and sodium percarbonate. Sodium percarbonate is especially preferred because it is very stable during storage and yet still dissolves very quickly in the bleaching liquor. It is believed that such rapid dissolution results in the formation of higher levels of percarboxylic acid and, thus, enhanced surface bleaching performance.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof may be preferred. See also U.S. Pat. No. 4,634,551 for other typical bleaches and activators useful herein.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

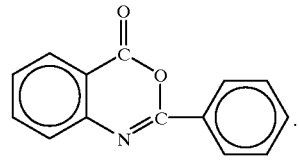

Still another class of preferred bleach activators includes the acyl lactam activators, especially acyl caprolactams and acyl valerolactams of the formulae:

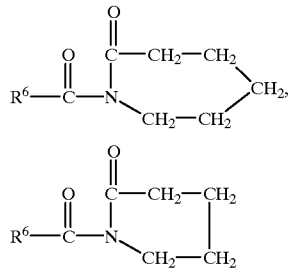

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

For compositions according to the present invention comprising a bleach, preferred are peroxyacid bleaching agents, of which amide substituted peroxyacid precursor compounds are more preferred, including those having the formula:

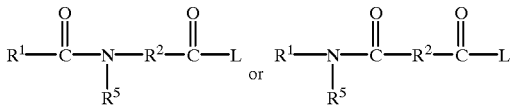

wherein $R^1$ is $C_1$–$C_{14}$ alkyl, aryl, alkylaryl, and mixtures thereof; $R^2$ is $C_1$–$C_{14}$ alkylene, arylene, alkylarylene, and mixtures thereof; $R^5$ is hydrogen, $C_1$–$C_{10}$ alkyl, aryl, alkylaryl, and mixtures thereof; L is any suitable leaving group (a preferred leaving group is phenyl sulfonate). $R^1$ preferably contains from 6 to 12 carbon atoms. $R^2$ preferably contains from 4 to 8 carbon atoms. $R^1$ may contain, where applicable, branching, substitution, or both and may be sourced from either synthetic sources or natural sources including for example, tallow fat. Analogous structural variations are permissible for $R^2$. The substitution can include alkyl, halogen, nitrogen, sulfur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3$(1,4,7-trimethyl-1,4,7-triazacyclononane)$_2(PF_6)_2$, $Mn^{IV}2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4(ClO_4)_4$, $Mn^{III}{}_4(u\text{-}O)_1(u\text{-}OAc)_2$-(1,4,7-trimethyl-1,4,7-triazacyclononane)2$(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13\text{-}15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerin, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

Soil Release Polymers

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

Suitable for use in the laundry detergent compositions of the present invention are soil release polymers comprising:

a) a backbone comprising:

i) at least one moiety having the formula:

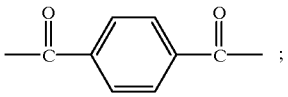

ii) at least one moiety having the formula:

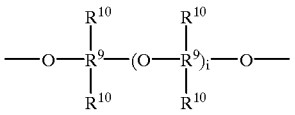

wherein $R^9$ is $C_2$–$C_6$ linear alkylene, $C_3$–$C_6$ branched alkylene, $C_5$–$C_7$ cyclic alkylene, and mixtures thereof; $R^{10}$ is independently selected from hydrogen or —L—$SO_3$—$M^+$; wherein L is a side chain moiety selected from the group consisting of alkylene, oxyalkylene, alkyleneoxyalkylene, arylene, oxyarylene, alkyleneoxyarylene, poly(oxyalkylene), oxyalkyleneoxyarylene, poly(oxyalkylene)oxyarlyene, alkylenepoly(oxyalkylene),and mixtures thereof; M is hydrogen or a salt forming cation; i has the value of 0 or 1;

iii) at least one trifunctional, ester-forming, branching moiety;

iv) at least one 1,2-oxyalkyleneoxy moiety; and b) one or more capping units comprising:

i) ethoxylated or propoxylated hydroxyethanesulfonate or ethoxylated or propoxylated hydroxypropanesulfonate units of the formula $(MO_3S)(CH_2)_m(R^{11}O)_n$—, where M is a salt forming cation such as sodium or tetralkylammonium, $R^{11}$ is ethylene or propylene or a mixture thereof, m is 0 or 1, and n is from 1 to 20;

ii) sulfoaroyl units of the formula —(O)C($C_6H_4$)($SO_3^-$ $M^+$), wherein M is a salt forming cation;

iii) modified poly(oxyethylene)oxy monoalkyl ether units of the formula $R^{12}O(CH_2CH_2O)_k$—, wherein $R^{12}$ contains from 1 to 4 carbon atoms and k is from about 3 to about 100; and iv) ethoxylated or propoxylated phenolsulfonate end-capping units of the formula $MO_3S(C_6H_4)(OR^{13})_nO$—, wherein n is from 1 to 20; M is a salt-forming cation; and $R^{13}$ is ethylene, propylene and mixtures thereof.

Most preferred end capping unit is the isethionate-type end capping unit which is a hydroxyethane moiety, $(MO_3S)(CH_2)_m(R^{11}O)_n$—, preferably $R^{11}$ is ethyl, m is equal to 0, and n is from 2 to 4.

An example of this preferred soil release agent has the formula:

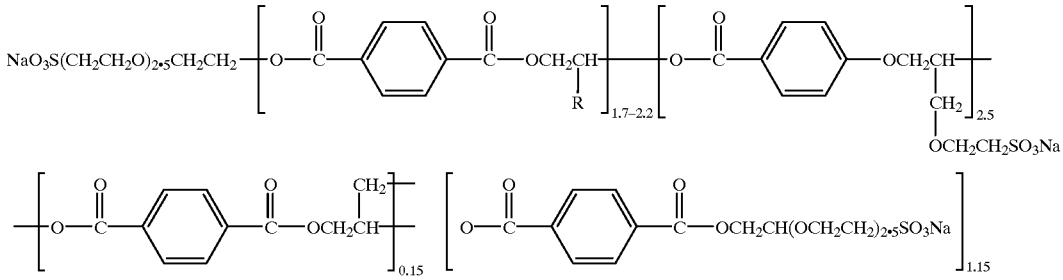

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et aL; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

The detergent compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

Granular Compositions

The bleach stable polyalkyleneimines of the present invention can be used in both low density (below 550 grams/liter) and high density granular compositions in which the density of the granule is at least 550 grams/liter. Granular compositions are typically designed to provide an in the wash pH of from about 7.5 to about 11.5, more preferably from about 9.5 to about 10.5. Low density compositions can be prepared by standard spray-drying processes. Various means and equipment are available to prepare high density compositions. Current commercial practice in the field employs spray-drying towers to manufacture compositions which have a density less than about 500 g/l. Accordingly, if spray-drying is used as part of the overall process, the resulting spray-dried particles must be further densified using the means and equipment described hereinafter. In the alternative, the formulator can eliminate spray-drying by using mixing, densifying and granulating equipment that is commercially available. The following is a nonlimiting description of such equipment suitable for use herein.

Various means and equipment are available to prepare high density (i.e., greater than about 550, preferably greater than about 650, grams/liter or "g/l"), high solubility, free-flowing, granular detergent compositions according to the present invention. Current commercial practice in the field employs spray-drying towers to manufacture granular laundry detergents which often have a density less than about 500 g/l. In this procedure, an aqueous slurry of various heat-stable ingredients in the final detergent composition are formed into homogeneous granules by passage through a spray-drying tower, using conventional techniques, at temperatures of about 175° C. to about 225° C. However, if spray drying is used as part of the overall process herein, additional process steps as described hereinafter must be used to obtain the level of density (i.e., >650 g/l) required by modem compact, low dosage detergent products.

For example, spray-dried granules from a tower can be densified further by loading a liquid such as water or a nonionic surfactant into the pores of the granules and/or subjecting them to one or more high speed mixer/densifiers. A suitable high speed mixer/densifier for this process is a device marketed under the tradename "Lödige CB 30" or "L ödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al, U.S. Pat. No. 5,149,455, issued Sep. 22, 1992. The preferred residence time in the high speed mixer/densifier is from about 1 to 60 seconds. Other such apparatus includes the devices marketed under the tradename "Shugi Granulator" and under the tradename "Drais K-TTP 80).

Another process step which can be used to density further spray-dried granules involves grinding and agglomerating or deforming the spray-dried granules in a moderate speed mixer/densifier so as to obtain particles having lower intra-particle porosity. Equipment such as that marketed under the tradename "Lödige KM" (Series 300 or 600) or "Lödige Ploughshare" mixer/densifiers are suitable for this process step. Such equipment is typically operated at 40–160 rpm. The residence time of the detergent ingredients in the moderate speed mixer/densifier is from about 0.1 to 12 minutes. Other useful equipment includes the device which is available under the tradename "Drais K-T 160". This process step which employs a moderate speed mixer/densifier (e.g. Lödige KM) can be used by itself or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration is also contemplated by the invention. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel et al, U.S. Pat. No. 5,133,924, issued Jul. 28, 1992 (granules are brought into a deformable state prior to densification); Delwel et al, U.S. Pat. No. 4,637,891, issued Jan. 20, 1987 (granulating spray-dried granules with a liquid binder and aluminosilicate); Kruse et al, U.S. Pat. No. 4,726,908, issued Feb. 23, 1988 (granulating spray-dried granules with a liquid binder and aluminosilicate); and, Bortolotti et al, U.S. Pat. No. 5,160,657, issued Nov. 3, 1992 (coating densified granules with a liquid binder and aluminosilicate).

In those situations in which particularly heat sensitive or highly volatile detergent ingredients (i.e. perfume ingredients) are to be incorporated into the final detergent composition, processes which do not include spray drying towers are preferred. The formulator can eliminate the spray-drying step by feeding, in either a continuous or batch mode, starting detergent ingredients directly into mixing/densifying equipment that is commercially available. One particularly preferred embodiment involves charging a surfactant paste and an anhydrous builder material into a high speed mixer/densifier (e.g. Lödige CB) followed by a moderate speed mixer/densifier (e.g. Lödige KM) to form high density detergent agglomerates. See Capeci et al, U.S. Pat. No. 5,366,652, issued Nov. 22, 1994 and Capeci et al, U.S. Pat. No. 5,486,303, issued Jan. 23, 1996. Optionally, the liquid/solids ratio of the starting detergent ingredients in such a process can be selected to obtain high density agglomerates that are more free flowing and crisp.

Optionally, the process may include one or more recycle streams of undersized particles produced by the process which are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See Capeci et al, U.S. Pat. No. 5,516,448, issued May 14, 1996 and Capeci et al, U.S. Patent 5,489,392, issued February 6, 1996. Other suitable processes which do not call for the use of spray-drying towers are described by Bollier et al, U.S. Pat. No. 4,828,721, issued May 9, 1989; Beerse et al, U.S. Pat. No. 5,108,646, issued Apr. 28, 1992; and, Jolicoeur, U.S. Pat. No. 5,178,798, issued Jan. 12, 1993.

In yet another embodiment, the high density detergent composition of the invention can be produced using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned L ödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier (residence time 5–30 seconds) so as to form agglomerates containing a partially or totally neutralized anionic surfactant salt and the other starting detergent ingredients. Optionally, the contents in the high speed mixer/densifier can be sent to a moderate speed mixer/densifier (e.g. Lödige KM) for further agglomeration resulting in the finished high density detergent composition. See Appel et al, U.S. Pat. No. 5,164,108, issued Nov. 17, 1992.

For the purpose of the invention, it may be preferred that the dispersants are premixed with anionic surfactants or a paste comprising anionic surfactants, such as sulfonate and sulfate surfactants, prior to addition of or to the other detergent ingredients.

It may be preferred that the dispersant of the invention or a composition comprising the dispersant, preferably a laundry detergent composition, is comprised in a detergent tablet or in the form of a detergent tablet. The tablets can be manufactured by any process known in the art. It may be preferred that the compositions are firstly formed by any of the processes described herein, in particularly agglomeration, prior to formation of the tablet.

EXAMPLE 1

PEI 3000 $E_{30}$

A 90 g portion of polyethyleneimine (PEI) having a listed average molecular weight of 3000 equating to about 0.03 moles of polymer and about 2.1 moles of nitrogen functions) is added to a 2 gallon stirred autoclave equipped for stirring even small volumes of liquid. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 92 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 11.3 g of sodium methoxide as a 25% sodium methoxide in methanol solution (0.21 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of a total of 2772 g of ethylene oxide (resulting in a total of 30 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 20.2 g methanesulfonic acid (0.21 moles). The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

EXAMPLE 2

PEI 3000 $P_3E_7$

A 90 g portion of polyethyleneimine (PEI) having a listed average molecular weight of 3000 equating to about 0.03 moles of polymer and about 2.1 moles of nitrogen functions) is added to a 2 gallon stirred autoclave equipped for stirring even small volumes of liquid. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Propylene oxide is then added to the autoclave incrementally over time while closely monitoring the autoclave pressure, temperature, and propylene oxide flow rate. The propylene oxide pump is turned off and cooling is applied to limit any temperature increase resulting from any reaction exotherm. The temperature is maintained between 100 and 110° C. while the total pressure is allowed to gradually increase during the course of the reaction. After a total of 122 grams of propylene oxide has been charged to the autoclave (roughly equivalent to one mole propylene oxide per PEI nitrogen function), the temperature is increased to 110° C. and the autoclave is allowed to stir for an additional hour. At this point, vacuum is applied to remove any residual unreacted propylene oxide.

Next, vacuum is continuously applied while the autoclave is cooled to about 50° C. while introducing 11.3 g of sodium methoxide as a 25% sodium methoxide in methanol solution (0.21 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Propylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of a total of 244 g of propylene oxide (resulting in a total of 3 moles of propylene oxide per mole of PEI nitrogen function) is achieved over several hours, the temperature is increased to 110° C. and the mixture stirred for an additional hour. At this point, vacuum is applied to remove any residual unreacted propylene oxide.

Ethylene oxide is then added to the autoclave incrementally while closely monitoring the autoclave pressure, temperature, and ethylene oxide flow rate while maintaining the temperature between 100 and 110° C. and limiting any temperature increases due to reaction exotherm. After the addition of a total of 2495 g of ethylene oxide (resulting in a total of 27 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 20.2 g methanesulfonic acid (0.21 moles). The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

The following describe high density liquid detergent compositions comprising alkoxylated polyamine dispersants according to the present invention:

TABLE I

| Ingredients | weight % 3 | 4 |
|---|---|---|
| Polyhydroxy Coco-Fatty Acid Amide | 3.65 | 3.50 |
| $C_{12}$–$C_{13}$ Alcohol Ethoxylate $E_9$ | 3.65 | 0.80 |
| Sodium $C_{12}$–$C_{15}$ Alcohol Sulfate | 6.03 | 2.50 |
| Sodium $C_{12}$–$C_{15}$ Alcohol Ethoxylate $E_{2.5}$ Sulfate | 9.29 | 15.10 |
| $C_{10}$ Amidopropyl Amine | 0 | 1.30 |
| Citric Acid | 2.44 | 3.0 |
| Fatty Acid ($C_{12}$–$C_{14}$) | 4.23 | 2.00 |
| Ethanol | 3.00 | 2.81 |
| Monoethanolamine | 1.50 | 0.75 |
| Propanediol | 8.00 | 7.50 |
| Boric Acid | 3.50 | 3.50 |
| Tetraethylenepentamine | 0 | 1.18 |
| Sodium Toluene Sulfonate | 2.50 | 2.25 |
| NaOH | 2.08 | 2.43 |
| Minors[1] | 1.60 | 1.30 |
| Soil Release Polymer[2] | 0.33 | 0.22 |
| Dispersant[3] | 0.50 | 0.50 |
| Water | balance | balance |

[1]Minors - includes optical brightener and enzymes protease, lipase, cellulase, and amylase).
[2]Non-Cotton Soil Release Polymer according to U.S. Pat. No. 4,968,451, Scheibel et al.
[3]PEI 3000 $E_{30}$ as described in Example 1 above.

TABLE II

| Ingredients | Weight % 5 | 6 | 7 | 8 | 9 |
|---|---|---|---|---|---|
| Polyhydroxy coco-fatty acid amide | 3.50 | 3.50 | 3.15 | 2.50 | 2.50 |
| NEODOL 23-9[1] | 2.00 | 0.60 | 2.00 | 0.63 | 0.63 |
| Sodium $C_{12}$–$C_{15}$ alcohol ethoxylate (1.8) sulfate | — | — | — | 20.15 | 20.15 |
| $C_{25}$ Alkyl ethoxylate sulphate | 19.00 | 19.40 | 19.00 | 17.40 | 14.00 |
| $C_{25}$ Alkyl sulfate | — | — | — | 2.85 | 2.30 |
| $C_{10}$-Aminopropylamide | — | — | — | 0.55 | 0.50 |
| Citric acid | 3.00 | 3.00 | 3.00 | 3.00 | 3.00 |
| Tallow fatty acid | 2.00 | 2.00 | 2.00 | 2.00 | 2.00 |
| Ethanol | 3.41 | 3.47 | 3.34 | 3.59 | 2.93 |
| Propanediol | 6.22 | 6.35 | 6.21 | 6.56 | 5.75 |
| Monomethanol amine | 1.00 | 0.50 | 0.50 | 0.50 | 0.50 |
| Sodium hydroxide | 3.05 | 2.40 | 2.40 | 2.40 | 2.40 |
| Sodium p-toluene sulfonate | 2.50 | 2.25 | 2.25 | 2.25 | 2.25 |
| Borax | 2.50 | 2.50 | 2.50 | 2.50 | 2.50 |
| Protease[2] | 0.88 | 0.88 | 0.88 | 0.88 | 0.88 |
| Lipolase[3] | 0.04 | 0.12 | 0.12 | 0.12 | 0.12 |
| Duramyl[4] | 0.10 | 0.10 | 0.10 | 0.10 | 0.40 |
| CAREZYME | 0.053 | 0.053 | 0.053 | 0.053 | 0.053 |
| Optical Brightener | 0.15 | 0.15 | 0.15 | 0.15 | 0.15 |
| Dispersant[5] | 1.18 | 1.18 | 1.18 | 0.50 | 1.75 |
| Soil release agent[6] | 0.22 | 0.15 | 0.0 | 0.0 | 0.0 |
| Soil release agent[7] | 0.0 | 0.0 | 0.15 | 0.15 | 0.0 |
| Soil release agent[8] | 0.0 | 0.0 | 0.0 | 0.0 | 0.15 |
| Fumed silica | 0.119 | 0.119 | 0.119 | 0.119 | 0.119 |
| Minors, aesthetics, water | balance | balance | balance | balance | balance |

[1]$C_{12}$–$C_{13}$ alkyl E9 ethoxylate as sold by Shell Oil Co.
[2]*Bacillus amyloliquefaciens* subtilisin as described in WO 95/10615 published April 20, 1995 by Genencor International.
[3]Derived from *Humicola lanuginosa* and commercially available from Novo.
[4]Disclosed in WO 9510603 A and available from Novo.
[5]PEI 3000 $E_{30}$ as described in Example 1 above.
[6]Terephthalate co-polymer as disclosed in U.S. Pat. No. 4,968,451, Scheibel et al., issued November 6, 1990.
[7]Soil release polymer according to U.S. Pat. No. 5,415,807, Gosselink et al., issued May 16, 1995.
[8]Soil release polymer according to U.S. Pat. No. 4,702,857, Gosselink, issued October 27, 1987.

TABLE III

| Ingredients | Weight % | | | | |
|---|---|---|---|---|---|
| | 10 | 11 | 12 | 13 | 14 |
| Polyhydroxy coco-fatty acid amide | 3.50 | 3.50 | 3.15 | 3.50 | 3.00 |
| NEODOL 23-9[1] | 2.00 | 0.60 | 2.00 | 0.60 | 0.60 |
| $C_{25}$ Alkyl ethoxylate sulphate | 19.00 | 19.40 | 19.00 | 17.40 | 14.00 |
| $C_{25}$ Alkyl sulfate | — | — | — | 2.85 | 2.30 |
| $C_{10}$-Aminopropylamide | — | — | — | 0.75 | 0.50 |
| Citric acid | 3.00 | 3.00 | 3.00 | 3.00 | 3.00 |
| Tallow fatty acid | 2.00 | 2.00 | 2.00 | 2.00 | 2.00 |
| Ethanol | 3.41 | 3.47 | 3.34 | 3.59 | 2.93 |
| Propanediol | 6.22 | 6.35 | 6.21 | 6.56 | 5.75 |
| Monomethanol amine | 1.00 | 0.50 | 0.50 | 0.50 | 0.50 |
| Sodium hydroxide | 3.05 | 2.40 | 2.40 | 2.40 | 2.40 |
| Sodium p-toluene sulfonate | 2.50 | 2.25 | 2.25 | 2.25 | 2.25 |
| Borax | 2.50 | 2.50 | 2.50 | 2.50 | 2.50 |
| Protease[2] | 0.88 | 0.88 | 0.88 | 0.88 | 0.88 |
| Lipolase[3] | 0.04 | 0.12 | 0.12 | 0.12 | 0.12 |
| Duramyl[4] | 0.10 | 0.10 | 0.10 | 0.10 | 0.40 |
| CAREZYME | 0.053 | 0.053 | 0.053 | 0.053 | 0.053 |
| Optical Brightener | 0.15 | 0.15 | 0.15 | 0.15 | 0.15 |
| Dispersant[5] | 1.18 | 1.18 | 1.18 | 1.18 | 1.75 |
| Soil release agent[6] | 0.22 | 0.15 | 0.15 | 0.15 | 0.15 |
| Fumed silica | 0.119 | 0.119 | 0.119 | 0.119 | 0.119 |
| Minors, aesthetics, water | balance | balance | balance | balance | balance |

[1]$C_{12}$–$C_{13}$ alkyl E9 ethoxylate as sold by Shell Oil Co.
[2]*Bacillus amyloliquefaciens* subtilisin as described in WO 95/10615 published April 20, 1995 by Genencor International.
[3]Derived from *Humicola lanuginosa* and commercially available from Novo.
[4]Disclosed in WO 9510603 A and available from Novo.
[5]PEI 3000 $E_{30}$ as described in Example 1 above.
[6]Terephthalate co-polymer as disclosed in U.S. Pat. No. 4,968,451, Scheibel et al., issued November 6, 1990.

EXAMPLES 15–21

Compositions of the present invention are also prepared by preparing high density granular formulas according to this example utilizing the alkoxylated poly amine dispersents alone or in combination with other soil release polymers.

TABLE IV

| Ingredient | weight % | | | | | | |
|---|---|---|---|---|---|---|---|
| | 15 | 16 | 17 | 18 | 19 | 20 | 21 |
| Sodium $C_{11}$–$C_{13}$ alkylbenzenesulfonate | 13.3 | 13.7 | 10.4 | 8.0 | 18.0 | 20.0 | 16.0 |
| Sodium $C_{14}$–$C_{15}$ alcohol sulfate | 3.9 | 4.0 | 4.5 | — | — | — | 4.0 |
| $C_{14}$–$C_{15}$ alcohol ethoxylate (0.5) sulfate | 2.0 | 2.0 | — | — | — | — | — |
| $C_{14}$–$C_{15}$ alcohol ethoxylate (3) sulfate | — | — | — | — | 1.0 | 1.0 | 1.0 |
| Sodium $C_{14}$–$C_{15}$ alcohol ethoxylate (6.5) | 0.5 | 0.5 | 0.5 | 5.0 | — | — | 0.6 |
| $C_9$–$C_{14}$ alkyl dimethyl hydroxy ethyl quaternary ammonium salt | 1.0 | — | — | 0.5 | 1.0 | 0.5 | 2.0 |
| Tallow fatty acid | 0.5 | — | — | — | — | — | 1.0 |
| Tallow alcohol ethoxylate (50) | — | — | 1.0 | 0.3 | — | — | — |
| Sodium tripolyphosphate | 0.0 | 41.0 | — | 20.0 | 20.0 | 15.0 | 20.0 |

TABLE IV-continued

| Ingredient | weight % | | | | | | |
|---|---|---|---|---|---|---|---|
| | 15 | 16 | 17 | 18 | 19 | 20 | 21 |
| Zeolite A, hydrate (0.1–10 micron size) | 26.3 | — | 21.3 | 1.0 | — | — | — |
| Sodium carbonate | 23.9 | 12.4 | 25.2 | 17.0 | 13.0 | 11.0 | 10.0 |
| Sodium Polyacrylate (45%) | 3.4 | 0.0 | 2.7 | — | — | — | — |
| Sodium polyacrylate/ maleate polymer | — | — | 1.0 | 1.5 | 1.0 | 2.0 | 0.5 |
| Sodium silicate (1:6 ratio $NaO/SiO_2$) (46%) | 2.4 | 6.4 | 2.1 | 6.0 | 9.0 | 6.0 | 8.0 |
| Sodium sulfate | 10.5 | 10.9 | 8.2 | 15.0 | 20.0 | 22.0 | 13.0 |
| Sodium perborate | 1.0 | 1.0 | 5.0 | 10.0 | 3.0 | 4.0 | 2.0 |
| Poly(ethyleneglycol), MW ~4000 (50%) | 1.7 | 0.4 | 1.0 | — | — | — | 0.5 |
| Sodium carboxy methyl cellulose | 1.0 | — | — | 0.3 | 0.5 | 0.5 | 0.5 |
| Citric acid | — | — | 3.0 | — | — | — | — |
| Nonyl ester of sodium p-hydroxybenzene-sulfonate | — | — | 5.9 | — | 0.7 | 1.0 | 2.0 |
| TAED | — | 3.0 | — | 1.5 | 0.3 | 0.5 | 0.5 |
| Soil release polymer[1] | 1.5 | — | — | 0.3 | — | — | — |
| Soil release polymer[2] | — | 1.5 | — | — | — | — | — |
| Soil release polymer[3] | 0.0 | 0.5 | 0.5 | — | — | — | 0.5 |
| Dispersant[4] | 0.5 | 0.5 | 0.5 | — | — | — | 0.5 |
| Dispersant[5] | — | — | — | 1.0 | 0.5 | 0.2 | — |
| Moisture | 7.5 | 3.1 | 6.1 | 7.3 | 5.0 | 3.0 | 5.0 |
| Magnesium sulphate | — | — | — | 1.0 | 1.0 | 0.5 | 1.5 |
| Chelant | — | — | — | 0.5 | 0.8 | 0.6 | 1.0 |
| Enzymes, including amylase, cellulase, protease and lipase | — | 1.0 | — | 1.5 | 2.0 | 1.5 | 2.0 |
| minors, e.g. perfume brightener, photo-bleach, dye | 1.0 | 1.0 | 1.0 | 1.0 | 0.5 | 1.5 | 1.0 |

[1]Non-cotton soil release polymer according to U.S. Pat. No. 4,968,451, Scheibel et al., issued November 6, 1990.
[2]Non-cotton soil release polymer according to U.S. Pat. No. 5,415,807, Gosselink, Pan, Kellett and Hall, issued May 16, 1995.
[3]Non-cotton soil release polymer according to U.S. Pat. No. 4,702,857, Gosselink, issued October 27, 1987.
[4]PEI 3000 $E_{30}$ as described in Example 1 above.
[5]PEI 3000 $P_3E_{27}$ as described in Example 2 above.
[6]Balance to 100% can, for example, include minors like optical brightener, perfume, suds suppresser, soil dispersant, protease, lipase, cellulase, chelating agents, dye transfer inhibiting agents, additional water, and fillers, including $CaCO_3$, talc, silicates, etc.

EXAMPLES 22–25

Suitable granular laundry detergent compositions comprising the alkoxylated polyamine dispersants of the present invention can be formulated without linear alkyl benzene sulfonates (LAS), for example:

TABLE V

| Ingredient | weight % | | | |
|---|---|---|---|---|
| | 22 | 23 | 24 | 25 |
| NEODOL 23-9[1] | 3.3 | 3.7 | — | 1.1 |
| Sodium $C_{14}$–$C_{15}$ alcohol sulfate | 13.9 | 14.0 | 14.5 | 21.2 |
| Sodium $C_{14}$–$C_{15}$ alcohol ethoxylate (0.5) sulfate | 2.0 | 2.0 | 0.0 | 0.0 |
| Sodium $C_{14}$–$C_{15}$ alcohol ethoxylate (6.5) | 0.5 | 0.5 | 0.5 | 1.0 |
| Tallow fatty acid | 0.0 | 0.0 | 0.0 | 1.1 |
| Sodium tripolyphosphate | 0.0 | 41.0 | 0.0 | 0.0 |
| Zeolite A, hydrate (0.1–10 micron size) | 26.3 | 0.0 | 21.3 | 28.0 |
| Sodium carbonate | 23.9 | 12.4 | 25.2 | 16.1 |
| Sodium Polyacrylate (45%) | 3.4 | 0.0 | 2.7 | 3.4 |
| Sodium silicate (1:6 ratio $NaO/SiO_2$)(46%) | 2.4 | 6.4 | 2.1 | 2.6 |

TABLE V-continued

| Ingredient | weight % | | | |
|---|---|---|---|---|
| | 22 | 23 | 24 | 25 |
| Sodium sulfate | 10.5 | 10.9 | 8.2 | 15.0 |
| Sodium perborate | 1.0 | 1.0 | 5.0 | 0.0 |
| Poly(ethyleneglycol), MW ~4000 (50%) | 1.7 | 0.4 | 1.0 | 1.1 |
| Citric acid | 0.0 | 0.0 | 3.0 | 0.0 |
| Nonyl ester of sodium p-hydroxybenzene-sulfonate | 0.0 | 0.0 | 5.9 | 0.0 |
| Soil release polymer[2] | 1.5 | 0.0 | 0.0 | 0.0 |
| Soil release polymer[3] | 0.0 | 1.5 | 0.0 | 0.0 |
| Soil release polymer[4] | 0.0 | 0.5 | 0.5 | 0.5 |
| Dispersant[5] | 0.5 | 0.5 | 0.5 | 0.5 |
| Moisture[6] | 7.5 | 3.1 | 6.1 | 7.3 |

[1]As sold by the Shell Oil Co.
[2]Soil release polymer according to U.S. Pat. No. 4,968,451, Scheibel et al., issued November 6, 1990.
[3]Soil release polymer according to U.S. Pat. No. 5,415,807, Gosselink, Pan, Kellett and Hall, issued May 16, 1995.
[4]Soil release polymer according to U.S. Pat. No. 4,702,857, Gosselink, issued October 27, 1987.
[5]PEI 3000 $E_{30}$ as described in Example 1 above.
[6]Balance to 100% can, for example, include minors like optical brightener, perfume, suds suppresser, soil dispersant, protease, lipase, cellulase, chelating agents, dye transfer inhibiting agents, additional water, and fillers, including $CaCO_3$, talc, silicates, etc.

What is claimed is:

1. A soil dispersant having the formula:

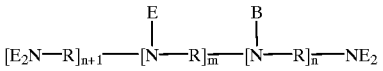

wherein R is $C_2$–$C_6$ linear alkylene, $C_3$–$C_6$ branched alkylene, and mixtures thereof; E is an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof; $R^2$ is hydrogen, C 1 –$C_4$ alkyl, and mixtures thereof; m is from about 10 to about 70; n is from about 5 to about 35; x is from about 20 to about 50; and B represents a continuation of the structure by branching.

2. A compound according to claim 1 wherein R is ethylene, 1,2-propylene, 1,3-propylene, and mixtures thereof.

3. A compound according to claim 2 wherein R is ethylene.

4. A compound according to claim 1 wherein $R^1$ is ethylene.

5. A compound according to claim 1 wherein from 80% to 95% of the $R^1$, units are ethylene and from 5% to 20% of the $R^1$ units are 1,2-propylene.

6. A compound according to claim 1 wherein $R^2$ is hydrogen, methyl, and mixtures thereof.

7. A compound according to claim 6 wherein $R^2$ is hydrogen.

8. A compound according to claim 1 wherein m is from 24 to about 60 and n is from 10 to about 25.

9. A compound according to claim 8 wherein m is from 30 to about 40 and n is from 15 to about 20.

10. A compound according to claim 1 wherein x is from about 25 to about 40.

11. A laundry detergent composition comprising:

a) from about 0.01% to about 95% by weight, of a detersive surfactant selected from the group consisting of anionic, nonionic, cationic, zwitterionic, and ampholytic surfactants, and mixtures thereof;

b) from about 0.05 to about 30% by weight, of a bleach;

c) from about 0.01 to about 10% by weight, a water-soluble or dispersible, alkoxylated polyamine having the formula:

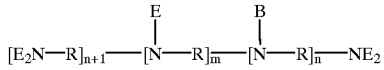

wherein R is $C_2$–$C_6$ linear alkylene, $C_3$–$C_6$ branched alkylene, and mixtures thereof; E is an alkyleneoxy unit having the formula:

$$—(R^1O)_xR^2$$

wherein $R^1$ is $C_2$–$C_4$ linear alkylene, $C_3$–$C_4$ branched alkylene, and mixtures thereof; $R^2$ is hydrogen, $C_1$–$C_4$ alkyl, and mixtures thereof; m is from about 10 to about 70; n is from about 5 to about 35; and x is from about 20 to about 50; B represents a continuation of the structure by branching; and d) the balance carriers and adjunct ingredients.

12. A composition according to claim 11 wherein R is ethylene, 1,2-propylene, 1,3-propylene, and mixtures thereof.

13. A composition according to claim 12 wherein R is ethylene.

14. A composition according to claim 11 wherein from 80% to 95% of the $R^1$ units are ethylene units, and from 5% to 20% of the $R^1$ units are 1,2-propylene, and mixtures thereof.

15. A composition according to claim 11 wherein $R^1$ is ethylene.

16. A composition according to claim 11 wherein $R^2$ is hydrogen, methyl, and mixtures thereof.

17. A composition according to claim 16 wherein $R^2$ is hydrogen.

18. A compound according to claim 1 wherein m is from 24 to about 60 and n is from 10 to about 25.

19. A compound according to claim 8 wherein m is from 30 to about 40 and n is from 15 to about 20.

20. A composition according to claim 11 wherein x is from about 25 to about 40.

21. A composition according to claim 11 wherein the adjunct ingredients are selected from the group consisting of builders, optical brighteners, bleaches, bleach boosters, bleach catalysts, bleach activators, soil release polymers, dye transfer agents, dispersents, enzymes, suds suppressers, dyes, perfumes, colorants, filler salts, hydrotropes, enzymes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

22. A composition according to claim 11 comprising from about 0.1% to about 60% by weight, of a detersive surfactant.

23. A composition according to claim 22 comprising form about 0.1% to about 30% by weight, of a detersive surfactant selected from the group consisting of anionic, cationic, nonionic, zwitterionic, ampholytic surfactants, and mixtures thereof.

24. A composition according to claim 11 comprising an oxygen bleaching agent selected from the group consisting of alkali metal percarbonate, perborate, monoperphthalate, pyrophosphate peroxyhydrate, urea peroxy-hydrate and mixtures thereof.

25. A composition according to claim 11 further comprising at least about 0.01% by weight, of a bleach activator wherein the oxygen bleach activator has the formula

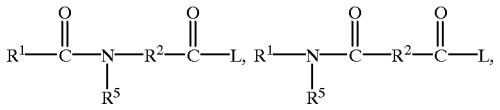

and mixtures thereof, wherein $R^1$ is $C_1$–$C_{14}$ alkyl, aryl, alkylaryl, and mixtures thereof; $R^2$ is $C_1$–$C_{14}$ alkylene, arylene, alkylarylene, and mixtures thereof; $R^5$ is hydrogen, $C_1$–$C_{10}$ alkyl, aryl, alkylaryl, and mixtures thereof; L is any suitable leaving group.

26. A composition according to claim 11 comprising at least 0.1% by weight, of TAED and alkanoyl oxybenzene sulfonate bleach activator.

27. A detergent tablet comprising the composition according to claim 11.

28. A laundry bleaching composition comprising:

a) from about 0.05 to about 30% by weight, of a peroxygen bleach;

b) from about 0.05 to about 50% by weight, of a bleach activator;

c) from about 0.01 to about 10% by weight, a water-soluble or dispersible, alkoxylated polyamine having the formula:

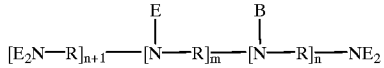

wherein R is $C_2$–$C_6$ linear alkylene, $C_3$–$C_6$ branched alkylene, and mixtures thereof, E is an alkyleneoxy unit having the formula:

wherein $R^1$ is $C_2$–$C_4$ linear alkylene, $C_3$–$C_4$ branched alkylene, and mixtures thereof; $R^2$ is hydrogen, $C_1$–$C_4$ alkyl, and mixtures thereof; m is from about 10 to about 70; n is from about 5 to about 35; and x is from about 20 to about 50; B represents a continuation of the structure by branching; and d) the balance carriers and adjunct ingredients.

* * * * *